United States Patent [19]

Ooms

[11] Patent Number: 4,710,451

[45] Date of Patent: Dec. 1, 1987

[54] HIGH CONTRAST DEVELOPMENT OF SILVER HALIDE EMULSION MATERIAL

[75] Inventor: Richard A. Ooms, Mechelen, Belgium

[73] Assignee: AGFA-Gevaert N.V., Mortsel, Belgium

[21] Appl. No.: 843,256

[22] Filed: Mar. 24, 1986

[51] Int. Cl.[4] ..... G03C 5/24; G03C 1/06; G03C 1/34

[52] U.S. Cl. ..... 430/441; 430/266; 430/444; 430/466; 430/489

[58] Field of Search ..... 430/266, 441, 444, 489, 430/466, 949

[56] References Cited

U.S. PATENT DOCUMENTS

| | | | |
|---|---|---|---|
| 2,948,612 | 8/1960 | De Angelus et al. | 430/489 X |
| 2,952,539 | 9/1960 | Dersch et al. | 430/489 X |
| 2,955,036 | 10/1960 | Dersch et al. | 430/489 X |
| 3,271,154 | 9/1966 | Dersch et al. | 430/489 X |
| 3,947,273 | 3/1976 | Pollet et al. | 430/266 |
| 3,972,719 | 8/1976 | Vanreusel et al. | 430/266 |
| 4,273,862 | 6/1981 | Yoshida et al. | 430/949 X |

FOREIGN PATENT DOCUMENTS 1343718 1/1974 United Kingdom .

*Primary Examiner*—John E. Kittle
*Assistant Examiner*—Mukund J. Sham
*Attorney, Agent, or Firm*—William J. Daniel

[57] ABSTRACT

A high contrast silver metal image can be formed in an exposed photographic silver halide emulsion layer material, the silver halide of which is at least 90 mole percent silver bromide, with the balance being silver chloride and/or silver iodide by developing the same in a developing medium in the presence of hydroquinone as sole developing agent, a large amount of sulphite derived from an inorganic sulphite compound, a nitroindazole anti-fogging agent, and a polyoxyethylene polymer, and an inorganic alkaline compound to impart to the medium a pH of at least 10.5 provided the amounts of these ingredients meets certain requirements.

13 Claims, No Drawings

HIGH CONTRAST DEVELOPMENT OF SILVER HALIDE EMULSION MATERIAL

DESCRIPTION

This invention relates to a method of effecting high contrast development of an image-wise exposed photographic silver halide emulsion layer material.

In the reproduction of continuous tone information for mechanical printing purposes, it is customary to make a half-tone photographic intermediate, usually a film negative, in which the gradations in tone are represented by dots of differing size. The quality of the resulting halftone picture is closely connected with the shape, spectral density, and uniformity of the dots of the half-tone print.

In order to obtain very high-contrast screen dots in halftone images it has been practice to formulate developers, so-called lith-developers, containing essentially a p-dihydroxybenzene such as hydroquinone, an alkali, an alkali metal bromide and a low level of free sulphite ions.

Very high contrast results, preferably with gamma above 10, also called "lith-gradation", can be obtained with said high-contrast developers and so-called "lith silver halide emulsion materials". In these materials the silver halide comprises at least 50 mole % of chloride, the balance, if any, being bromide and optionally a minor amount of iodide. The relationship of lith-gradation and sharpness of screen dots is discussed in the handbook of Modern Halftone Photography of E. Fred Noemer—published by Perfect Graphic Arts Demarest, N.J.—U.S.A. (1965) pages 54–55.

Hydroquinone developers having a low sulphite ion concentration are commonly referred to as "lith-type developers" and their mechanism of operation is described by J. A. C. Yule in the Journal of the Franklin Institute, 239 (1945), pages 221 to 230.

The properties of these lith-type developers are believed to result from autocatalytic action, often called "infectious development", due to a local high concentration of the oxidation products of the developing agent, which can build up as a result of the low sulphite ion concentration that has to be kept at low level to maintain the lith-development characteristic. This is achieved in all known commercial developers of this type by the use of the addition product of formaldehyde and sodium hydrogen sulphite, i.e. sodium formaldehyde hydrogen sulphite, which acts as a sulphite ion buffer.

In conventional "lith" developers the low sulfite ion concentration is inadequate to provide effective protection against aerial oxidation. As a result, a conventional "lith" developer is lacking in stability and tends to give erratic results depending on the length of time that it has been exposed to air.

With the advent of processing machines and more particularly, rapid access processing machines, the deficiencies of lithographic processing chemistry became serious and apparent. Developer degradation was accelerated under machine processing conditions.

In the development of the exposed silver halide emulsion a certain quantity of the developing compounds and of the oxidation-inhibiting compounds is used up and halide ions of the developed silver halide enter the developing solution.

How fast the exhaustion of the developer proceeds is dependent on the number and kind of photographic material processed and the content of developable (exposed or fogged) silver halide in the material.

As is generally known the composition of a developer solution used in silver halide photography changes also because of a chemical reaction taking place by contact with the oxygen of the air. The continuous contact of the developer solution with the oxygen of the air results in the oxidation of an amount of the developing agents and oxidation-inhibiting compounds and in this way changes the reducing capacity of the developer. The longer the contact time and the larger the area of contact between the developer liquid and the air the more rapidly oxidation will take place. Aerial oxidation is also influenced by the temperature of the developer solution, i.e. the higher the temperature the more intense the aerial oxidation proceeds. These chemical changes have a certain influence on the photographic characteristics of the finally obtained images.

As explained e.g. in U.S. Pat. No. 4,081,280 it is necessary when using a lith-developer with low free sulphite content to replenish carefully the developer solution in order to compensate:

(1) for developer exhaustion by aerial oxidation, and (2) consumption of developer as a function of the treated exposed photographic material.

In machine-processing the classical lith-developer poses a further problem in the so-called "cross-over" of the photographic material between the development tank and the fix tank. Indeed, if we consider development time to start when the film first enters the developer and to end when it first enters the fix tank then a rather large time is spent in the cross-over. The "cross-over period" is expressed in percent with respect to the treating time in the developer. During the cross-over period the exhausted developer has no chance to be replenished by fresh developr because the film is out of solution. Thus, during the cross-over period, development is prematurely terminated owing to local developer exhaustion. This leads to a low contrast or so-called "pulled-out" toe which gives significantly poorer dot quality. Said problem is particularly apparent when classical lith-development is carried out in shallow processing tanks or trays operating with a relatively large cross-over period, so that to avoid that problem machine-processing in classical lith-development has to proceed within a relatively large path of travel in relatively deep tanks to enlarge the development period with respect to the cross-over period. This makes the developer apparatus expensive and bulky by the use of an extensive roller transport system.

According to GB-P No. 1,376,600 and corresponding U.S. Pat. No. 3,972,719 in order to be less dependent on replenishment for aerial oxidation a high contrast developer with relatively high sulphite content and an anti-fogging nitro-compound is provided. Said developer contains not more than 0.05 g/liter of any auxiliary developing agent that shows a superadditive developing effect with a p-dihydroxybenzene developing agent and may contain a polymer containing a plurality of alkylene oxide units, i.e. a polymeric oxyalkylene compound, for controlling the development speed.

Up till now the characteristic of lith-development resulting in particularly high gradation necessary for sharp screen dot reproduction is restricted to the use of silver halide emulsion layers the silver halide of which is mainly silver chloride. It has been established that silver chloride has a higher solubility than silver bromide especially in aqueous solutions with high sulphite content. Hereby losses with regard to image density may arise together with the formation of silver sludge stemming from the reduced dissolved silver halide in the sulphite containing developer. Moreover, silver chloride has an inherent spectral sensitivity that is practically limited to the ultra-violet spectral range, whereas the inherent sensitivity of silver bromide extends into the blue part of the visible spectrum. So, it would be very advantageous if the lith-effect could be extended to the range of silver halide emulsions the silver halide of which is mainly silver bromide or silver bromide exempt of chloride associated with minor amounts of silver iodide.

It is an object of the present invention to provide a process of high contrast development with rapid access to the developed image wherein a developer is used possessing a good stability against oxidation by oxygen of the air and wherein the development can proceed in shallow tray automatic processors having a large cross-over period without impairing the dot quality of graphic art screen images.

It is a further object of the present invention to provide a development process for high gradation development of an image-wise exposed photographic silver halide emulsion material, wherein the development proceeds with poor silver sludge formation although a relatively large concentration of sulfite in the developer is present.

Other objects and advantages of the present invention will appear from the further description and examples.

The present invention provides a method for high contrast development of an image-wise exposed photographic silver halide emulsion layer material, characterized in that an image-wise exposed silver halide emulsion material the silver halide of which is at least 90 mole percent silver bromide, the remainder if any, being chloride and/or iodide, is developed in the presence of the following ingredients (1) to (4) in an aqueous medium, called developer liquid, having a pH of at least 1.05, preferably having a pH in the range of 10.8 to 11.8, and wherein said ingredients (a) to (d) are:

(a) hydroquinone or a substituted hydroquinone as sole developing agent, (b) free sulphite ions in an amount of at least 5 grams per liter, (c) an organic anti-fogging agent corresponding to the following general formula (A):

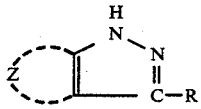

(A)

wherein:

Z represents the necessary atoms to complete a nitro-substituted homocyclic aromatic nucleus, e.g. a nitro-substituted benzene nucleus forming a 5- or 6-nitro-substituted indazole compound or such nucleus in further substituted state, e.g. further substituted with alkyl, e.g. methyl, or with a sulphonic acid group in salt form, and R is hydrogen or a lower ($C_1$–$C_5$) alkyl group, and (d) a polymer containing a plurality of alkylene oxide units and having a molecular weight of at least 1500, said ingredients (a), (b), (c) and (d) being present during said development in such amounts that when said photographic material is image-wise exposed through a continuous tone wedge and developed in the presence of said ingredients under the subsequently identified test conditions the development and fixing results in a silver wedge image corresponding with a log exposure versus density sensitometric curve wherein the maximum gradient ($\gamma$) is at least 5 and the product of said maximum gradient ($\gamma$) and of the gradient in the toe ($\gamma v$) of said curve is at least 20; the maximum gradient is measured between the log exposure values corresponding with the densities 0.3 and 3.0 above fog of said curve and the gradient in the toe is measured between the log exposure values corresponding with the densities 0.1 and 0.6 above fog of said curve.

Before development the ingredients (1), (3) and/or (4) are present wholly or partly in the photographic material being incorporated therein already during its manufacturing stage.

Hydroquinone compounds that may be used according to the present invention include unsubstituted hydroquinone and e.g. the following substituted hydroquinones:

chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,5-dimethylhydroquinone,
2,5-diethylhydroquinone,
2,5-di-p-phenethylhydroquinone,
2,5-dibenzoylaminohydroquinone, or
2,5-diacetaminohydroquinone and mixtures thereof.

The preparation of these hydroquinone compounds is known to those skilled in the art.

The developing agent may be present in the photographic material, e.g. in a silver halide photographic emulsion layer or in a layer in water-permeable relationship therewith. In that case the development may be carried out by contacting the photographic material with an alkaline aqueous liquid free from developing agent(s) but containing ingredient (2) and optionally the other ingredients (3) and/or (4). The coverage of the developing agent in the photographic material is e.g. in the range of 0.1 to 5 g/m2. When applied in the developer liquid the developing agent is preferably used in a concentration in the range of 10 to 60 g/l.

The sulphite ions (ingredient 2) are incorporated into the developer composition starting preferably from an alkaline metal hydrogen bisulphite or metabisulphite or a corresponding ammonium salt. The concentration of free sulphite ion is preferably in the range of 15 to 80 grams per liter.

The above defined nitro-indazole anti-fogging agents (ingredient 3) can be prepared as described in GB-P No. 1,376,600.

Such anti-fogging agents may be incorporated in the light-sensitive material already in the course of its manufacturing stage so as to be indirectly introduced therefrom into the developing liquid but they are used preferably as one of the ingredients dissolved in the developer liquid before starting the development.

When present in the photographic material said antifogging agent is applied at a coverage up to 100 mg per m2.

In the developer liquid the concentration of said antifogging agent is preferably up to 1000 mg per liter.

According to a particularly preferred embodiment in the process of the present invention an aqueous alkaline developer composition is used that has a pH between 10.8 and 11.8 and contains 5-nitro-indazole in an amount of about 300 mg per liter.

Suitable polyalkylene oxide polymers also called polymeric oxyalkylene compounds for use according to the present invention are polyalkyleneoxides as such, e.g. polyethylene oxides of a molecular weight above 1500 or condensation products thereof with e.g. alcohols, glycols, phosphoric acids, sulphonic acids, aliphatic amines and diamines. Examples of condensation products containing oxyalkylene units are described e.g. in the United Kingdom Patent Specifications Nos. 600,058 filed Jan. 10. 1946 by E. I. du Pont de Nemours, 871,801 filed Nov. 30, 1956 by Kodak, 920,637 filed May 7, 1959, 940,051 filed Nov. 1, 1961, 945,340 filed Oct. 23, 1961, 949,643 filed Nov. 2, 1961, all four by Gevaert Photo-Producten N.V., 991,608 filed June 14, 1961 by Kodak, 1,015,023 filed Dec. 24, 1962, 1.091,705 filed May 20, 1965, both by Gevaert Photo-Producten N.V., 1,107,022 filed Oct. 7, 1965, 1,147,817 filed Aug. 19, 1966, 1,162,135 filed Oct. 11, 1965 and 1,184,434 filed Aug. 30, 1966 all four by Gevaert-Agfa N.V., in the published German Patent Applications Nos. 1,141,531 filed Jan. 24, 1962 by Perutz Photowerke G.m.b.H., 1,188,439 filed May 16, 1964 by Fuji Shashin Film Kabushiki Kaisha, and in the U.S. Pat. Nos. 1,970,578 of Conrad Schoeller and Max Wittwer, issued Aug. 21, 1934, 2,240,472 of Donald R. Swan, issued Apr. 29, 1941, 2,423,549 of Ralph K. Blake, William Alexander Stanton, Ferdinand Schulze, issued July 8, 1947, 2,441,389 of Ralph K. Blake, issued May 11, 1948.

Preferred polyoxyalkylene compounds for use in the present development process are polymers containing an average number of at least 30 repeating oxyethylene units. Particularly good results are obtained with polyoxyethylene compounds having an average number of 70 repeating oxyethylene units. Particularly suited polyoxyethylene polymers for use according to the present invention are disclosed in U.S. Pat. No. 3,947,273 of Pollet et al., issued Mar. 30, 1976. These polymers contain end-groups improving the water-solubility. An example of a preferred polyoxyethylene polymer having ionic end groups corresponds to the following structural formula:

$$^{+}X.^{-}O-SO_2-(CH_2-CH_2-O)_n-CH_2-CH_2-SO_2-O^{-}.X^{+},$$

wherein n is e.g. 30 to 200, and $X^+$ is a cation, e.g. sodium ion.

The polyoxyalkylene compounds may be present in the photographic material already in its manufacturing stage, e.g. in the silver halide emulsion layer and/or in a layer in waterpermeable relationship therewith at a coverage preferably not surpassing 250 mg per m2. In the developer liquid said compounds are used e.g. in a concentration up to 2500 mg per liter.

Other adjuvants well known to those skilled in the art of developer formulation may be added to the developer liquid used according to the present invention.

A survey of conventional developer addenda is given by Grant Haist in "Modern Photographic Processing"—John Wiley and Sons—New York (1979) p. 220–274. Such addenda are e.g. restrainers, such as the soluble halides, e.g. applied as potassium bromide, organic solvents improving the solubility of developing agents, organic anti-foggants, preservatives, e.g. biocides and puffering agents, e.g. carbonates, phosphates and borates.

The developer liquid used according to the present invention may contain free bromide ions the concentration of which is preferably in the range of 0.5 to 15.0 g per liter developer solution.

Organic solvent(s) for improving the dissolution of hydroquinone in aqueous medium are described e.g. in U.S. Pat. No. 4,030,920, GB-P No. 1,343,718 and FR-P No. 41095 (publication No. 2,114,785). Solvents for said purpose are watermiscible solvents of the class of amides, alcohols, organic diol compounds and half-ethers thereof. Preferred watermiscible solvents are dimethylformamide, dimethylacetamide, N-methyl-2-pyrrolidinone and 3-methoxy-2-propanol. These solvents may be present in an amount in the range of 5 to 250 g per liter of the developer liquid.

The developer formulation may be prepared in a concentrated form and diluted to a working strength just prior to use. Concentrated solutions for automatic processing are widely used in processing machines operating with a replenishment system. The developer may be kept in two parts before use and combined and diluted to the desired strength with water. Thus, the antifogging agent(s) and polyoxyalkylene polymers may be kept in acid medium in one part and the other ingredients in alkaline medium in the other part.

Developer solutions used according to the present invention can be left in a machine processor for several weeks without marked degradation. The replenishment proceeds simply by adding a fresh amount of developer after discarding an exhausted portion.

The silver bromide type emulsions for use according to the present invention are preferably silver bromide-iodide emulsions the silver halide of which contains no more than 10 mole % of iodide, more preferably not more than 6 mole % iodide.

The silver halide coverage may be equivalent with a coverage of silver in the range of 1.5 to 6 g/m2, preferably in the range of 2 to 4 g of silver per m2. The silver halide grain size is preferably in the range of 0.05 to 1 um.

The silver halide emulsions may contain any of the hydrophilic water-permeable binding materials suitable for this purpose. Suitable materials include gelatin, colloidal albumin, polyvinyl compounds, cellulose derivatives, acrylamide polymers etc. Mixtures of these binding agents may be used. The binding agents for the emulsion layer of the high contrast photographic element may also contain dispersed polymerized vinyl compounds. Such compounds are disclosed in e.g. the U.S. Pat. Nos. 3,142,568 of Robert William Nottorf, issued July 28, 1964, 3,193,386 of Clayton F. A. White, issued July 6, 1965, 3,062,674 of Robert Wong, issued Nov. 6, 1962, 3,220,844 of Robert C. Houck, Donald A. Smith and Joseph S. Yudelson, issued Nov. 30, 1965. They include the water-insoluble polymers of alkyl acrylates and methacrylates, acrylic acid, sulfoalkyl acrylates or methacrylates, copolymers of alkyl acrylates with acrylic acids, acryloyl-oxyalkyl sulphonic acids, acetoacetoxy alkyl acrylates such as 2-acetoacetoxyethyl methacrylate and the like. These compounds may be incorporated likewise into a layer separate from the silver halide emulsion layer of the photographic element. The vinyl polymers are generally employed in concentrations of about 20 to about 80%, most often in concentrations of at least 30% by weight based on the weight of the total binder content.

Silver halide emulsions wherein the binder partly consists of poly-N-vinylpyrrolidinone as described in U.S. Pat. Nos. 3,617,284 provide particularly high gradation results.

The silver halide emulsion layer(s) processed according to the present invention may be coated on a wide variety of supports. If desired, hydrophilic colloid layers are coated on one or both sides of the support.

Typical supports are cellulose nitrate film, cellulose ester film, polyvinyl acetal film, polystyrene film, poly(ethylene terephthalate) film, and related films or resinous materials, as well as glass, paper, metal and the like. Supports such as paper, which are coated with alpha-olefin polymers, particularly polymers of alpha-olefins containing two or more carbon atoms, as exemplified by polyethylene polypropylene, ethylene-butene copolymers and the like may be employed likewise.

A silver halide emulsion material suitable for processing according to the present invention may be sensitized chemically according to any of the well-known techniques in emulsion make, e.g. by digesting with naturally active gelatin or various sulphur, selenium, tellurium compounds and/or gold compounds. The emulsions can be sensitized with salts of noble salts of Group VII of the Periodic Table, which have an atomic weight higher than 100.

A silver halide emulsion material suitable for processing according to the present invention may be sensitized spectrally, e.g. is ortho-sensitized or pan-sensitized, with known spectral sensitizing dyes. For instance, the silver halide can be sensitized spectrally by treatment with a solution of a sensitizing dye in an organic solvent. Spectral sensitizers that may be used are e.g. the cyanines, merocyanines, complex (trinuclear) cyanines, complex (trinuclear) merocyanines, styryls, and hemicyanines.

A silver halide emulsion material to be processed according to the present invention may also contain conventional addenda such as, plasticizers, coating aids, fog-inhibiting compounds other than the already mentioned compound of general formula (A), such as the mercapto derivatives of benzoxazole, benzthiazole, benzimidazole, benztriazole or tetrazole, particularly 1-phenyl-5-mercaptotetrazole and azaindene compounds, particularly 4-hydroxy substituted (1,3,3a,7)-tetraazaindenes. Further the silver halide emulsion material may contain hardeners, e.g. aldehyde hardeners such as formaldehyde, mucochloric acid, glutardialdehyde and maleic dialdehyde, aziridines, oxypolysaccharides, dimethylurea, hydroxychlorotriazine, divinyl sulphones and/or triacrylformal.

In processing photographic elements according to the present invention, the time and temperature employed for development can be varied widely. Typically, the development temperature will be in the range of from about 20° C. to about 50° C., while the development time in rapid access normally lasts no longer than 90 s.

The following examples illustrate the invention without however limiting it thereto.

EXAMPLE 1

A cubic grain type silver iodo-bromide (1 mole % of iodide) emulsion having an average grain size of 0.2 um, chemically sensitized with ammonium gold(III) thiocyanate and sodium thiosulphate and stabilized with 4-hydroxy-6-methyl-(1,3,3a,7)-tetraazaindene was coated onto a subbed polyethylene terephthalate support at a gelatin coverage of 3.4 g per sq.m. and a coverage of silver halide equivalent with 2.9 g of silver per sq.m.

The silver halide emulsion layer was coated with a protective layer containing formaldehyde-hardened gelatin at a coverage of 0.8 g of gelatin per sq.m.

The photographic material was contact-exposed in different area through respectively a continuous tone wedge having a constant 0.15 and a grey negative screen for use in screen sensitometry having a screen ruling of 54 lines per cm.

The development proceeded by dipping the exposed photographic material into a tray for 35 s at a temperature of 38° C. (i.e. rapid access procedure) using a developer having the following composition:

| | |
|---|---|
| ethylenediamine tetra-acetic acid sodium salt | 1 g |
| sodium carbonate | 40 g |
| sodium bromide | 4 g |
| sodium sulphite | 70 g |
| hydroquinone | 40 g |
| dimethylformamide | 30 ml |
| 5-nitro-indazole | (mg/l as in Table 1) |
| polyoxyethylene glycol (average number of oxyethylene units being 70) | 200 mg |
| water up to | 1 l |
| pH adjusted to 11.5 with sodium hydroxide. | |

To said composition for comparative test purposes increasing amounts of 5-nitro-indazole (NI) were added as indicated in Table 1 hereinafter.

The fixing proceeded for 3 min at 25° C. in a tray using a fixing bath having the following composition:

| | |
|---|---|
| ammonium thiosulphate (anhydrous) | 100 g |
| sodium sulphite (anhydrous) | 10 g |
| boric acid | 5 g |
| sodium acetate | 15 g |
| acetic acid, glacial | 8 ml |
| water to make | 1 l |

The photographic speed was expressed in relative sensitivity values (rel. S) and was measured at density 3.0 above fog. The speed obtained with the developer containing 300 mg/l of 5-nitro-indazole was arbitrarily given the value 100.

Gradient values in the toe ($\gamma_v$) of the sensitometric curve were measured between the log exposure values at densities 0.1 and 0.6 above fog on the log exposure scale of the sensitometric curve. Straight-line gradient (maximum gradient) values ($\gamma$), were measured between the log exposure values at densities 0.3 and 3.0 above fog on the log exposure scale of the sensitometric curve.

The screen dot quality was assessed and the rating expressed by numbers, wherein increasing numbers stand for degrading quality. Number 0 stands for developed screen dots having high optical density and sharp, non-indented edges. The other numbers relate to screen dots gradually reduced optical density and dot wedges with increasing indentation and fuzzy structure. Above number 3 the quality is considered to be no longer commercially acceptable.

TABLE 1

| Test No. | NI mg/l | rel. S | $\gamma_v$ | $\gamma$ | dot quality rating |
|---|---|---|---|---|---|
| 1 | none | 294 | 1.3 | 3.0 | 5 |
| 2 | 75 | 275 | 1.9 | 4.1 | 5 |
| 3 | 200 | 224 | 3.6 | 6.6 | 3 |
| 4 | 250 | 182 | 5.4 | 9.8 | 1 |
| 5 | 300 | 100 | 3.8 | 14.1 | 2 |
| 6 | 350 | 80 | 2.1 | 10.2 | 3 |

EXAMPLE 2

5-nitro-indazole was added in a ratio of 1.5 mmole/mole of silver halide to a cubic grain type silver iodobromide (1 mole % of iodide) emulsion having an average grain size 0.2 um, chemically sensitized with ammonium gold(III) thiocyanate and sodium thiosulphate and stabilized with 4-hydroxy-6-methyl-(1,3,3a,7)-tetraazaindene. Said silver halide emulsion was coated onto a subbed polyethylene terephthalate support at a gelatin coverage of 3.4 g per sq.m. and a coverage of silver halide equivalent with 2.9 g of silver per sq.m.

The silver halide emulsion layer was coated with a protective layer containing formaldehyde-hardened gelatin at a coverage of 0.8 g of gelatin per sq.m.

The photographic material was contact-exposed in different area through respectively a continuous tone wedge having a constant 0.15 and a grey negative screen for use in screen sensitometry having a screen ruling of 54 lines per cm.

The development proceeded by dipping the exposed photographic material into a tray for 35 s at a temperature of 38° C. using a developer having the following composition:

| | |
|---|---|
| ethylenediamine tetra-acetic acid sodium salt | 1 g |
| sodium carbonate | 40 g |
| sodium bromide | 4 g |
| sodium sulphite | 70 g |
| hydroquinone | 40 g |
| dimethylformamide | 30 ml |
| water up to | 1 l |
| pH adjusted to 11.5 with sodium hydroxide. | |

To said composition for comparative test purposes increasing amounts of 5-nitro-indazole (NI) and 200 mg of polyoxyethylene glycol having an average number of 70 repeating oxyethylene units were added.

The fixing proceeded for 3 min at 25° C. in a tray using a fixing bath having the following composition:

| | |
|---|---|
| ammonium thiosulphate (anhydrous) | 100 g |
| sodium sulphite (anhydrous) | 10 g |
| boric acid | 5 g |
| sodium acetate | 15 g |
| acetic acid, glacial | 8 ml |
| water to make | 1 l |

The photographic speed was expressed in relative sensitivity values (rel. S) and was measured at density 3.0 above fog. The speed obtained with the developer containing 100 mg/l of 5-nitro-indazole was arbitrarily given the value 100.

Gradient values in the toe ($\gamma_v$) of the sensitometric curve as defined hereinbefore were measured between the log exposure values at densities 0.1 and 0.6 above fog on the log exposure scale of the sensitometric curve. Straight-line gradient (maximum gradient) values ($\gamma$), were measured between the log exposure values at densities 0.3 and 3.0 above fog on the log exposure scale of the sensitometric curve.

The screen dot quality was assessed and the rating expressed by numbers, wherein increasing numbers stand for degrading quality. Number 0 stands for developed screen dots having high optical density and sharp, non-indented edges. The other numbers in increasing order relate to screen dots having gradually reduced optical density and dot edges with increasing indentation and fuzzy structure. Above number 3 the quality is considered to be no longer commercially acceptable.

TABLE 2

| Test No. | NI mg/l | rel. S | $\gamma_v$ | $\gamma$ | dot quality rating |
|---|---|---|---|---|---|
| 1 | none | 257 | 1.7 | 4.2 | 5 |
| 2 | 25 | 240 | 3.3 | 5.5 | 4 |
| 3 | 50 | 224 | 4.1 | 6.2 | 2 |
| 4 | 75 | 209 | 5.2 | 8.3 | 0 |
| 5 | 100 | 100 | 3.5 | 11.5 | 1 |
| 6 | 125 | 44 | 2.5 | 9.2 | 3 |

EXAMPLE 3

The photographic material of Example 2 was exposed, developed and fixed as described in Example 2 in Test No. 4, with the proviso that the developer compositions used in the following Tests No. 1 to 6 contained increasing amounts of said polyethylene glycol (PG) in the concentration defined in the following Table 3.

The photographic speed is expressed in relative sensitivity values. The speed obtained with the photographic material of Example 2, exposed and developed as described in Example 2, test No. 5 is arbitrarily given the value 100 which is taken as a reference value.

TABLE 3

| Test No. | PG mg/l | rel. S | $\gamma_v$ | $\gamma$ | dot quality rating |
|---|---|---|---|---|---|
| 1 | none | 250 | 1.6 | 3.9 | 5 |
| 2 | 50 | 245 | 3.6 | 4.8 | 4 |
| 3 | 100 | 245 | 4.1 | 5.4 | 3 |
| 4 | 200 | 209 | 5.2 | 8.3 | 0 |
| 5 | 350 | 105 | 2.1 | 10.1 | 3 |
| 6 | 500 | 39 | 2.0 | 4.8 | 4 |

EXAMPLE 4

The photographic material of Example 2 was exposed, developed and fixed as described in Example 2 in Test No. 4, with the proviso however, that different concentrations of sodium hydroxide were used in order to vary the pH. The obtained results in function of the varying pH values are listed in the following Table 4.

The photographic speed is expressed in relative sensitivity values. The speed obtained with the photographic material of Example 2, exposed and developed as described in Example 2, test No. 5 is arbitrarily given the value 100 which is taken as a reference value.

TABLE 4

| Test No. | pH | rel. S | $\gamma_v$ | $\gamma$ | dot quality rating |
|---|---|---|---|---|---|
| 1 | 11.00 | 22 | 1.0 | 3.3 | 5 |
| 2 | 11.25 | 91 | 3.3 | 7.6 | 2 |
| 3 | 11.50 | 209 | 5.2 | 8.3 | 0 |
| 4 | 11.75 | 224 | 6.1 | 8.1 | 1 |

TABLE 4-continued

| Test No. | pH | rel. S | $\gamma_v$ | $\gamma$ | dot quality rating |
|---|---|---|---|---|---|
| 5 | 12.00 | 240 | 4.8 | 5.2 | 3 |

EXAMPLE 5

The photographic material of Example 2 Test No. 4 was exposed and processed as described in Example 2 but developed at 38° C. for 45 seconds in a RAPILINE 66 (trade name of Agfa-Gevaert N.V. Belgium) shalow tray automatic processor having a "cross-over period" of 22%. The obtained maximum gradient ($\gamma$) and gradient value in the toe ($\gamma$v) as defined hereinbefore is 8.5 and 3.8 respectively. The screen dot quality rating is 1.

I claim:

1. A method of effecting high contrast development of an image-wise exposed photographic negative-working silver halide emulsion layer material, the silver halide of which is at least 90 mole percent silver bromide, with the balance being silver chloride and/or silver iodide, which comprises developing said exposed material in the presence of the following ingredients in an aqueous developing medium having a pH of at least 10.5:

(a) hydroquinone or a substituted hydroquinone as sole developing agent in said medium, (b) an inorganic sulfite compound providing free sulphite ions in an amount of at least 5 grams per liter, (c) an organic anti-fogging agent corresponding to the following general formula (A):

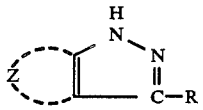

(A)

wherein:

Z represents the necessary atoms to complete a nitro-substituted homocyclic aromatic nucleus, and R is hydrogen or a lower ($C_1$–$C_5$) alkyl group, (d) a polymer containing a plurality of alkylene oxide units and having a molecular weight of at least 1500, and (e) an inorganic alkaline compound imparting said pH to said medium, said ingredients (a), (b), (c), (d) and (e) being present in said developing medium during said development in such amounts that when said photographic material is image-wise exposed through a continuous tone wedge and test developed in the thus-constituted developing medium for a time of 35 sec. at 38° C. and then fixed there results a silver wedge image corresponding with a log exposure versus density sensitometric curve wherein the maximum gradient ($\gamma$) is at least 5 and the product of said maximum gradient ($\gamma$) ad of the gradient in the toe ($\gamma$v) of said curve is at least 20, the maximum gradient being measured between the log exposure values corresponding with the densities 0.3 and 3.0 above fog of said curve and the gradient in the toe being measured between the log exposure values corresponding with the densities 0.1 and 0.6 above fog of said curve.

2. Method according to claim 1, wherein the ingredients (a), (c) and/or (d) are carried in the photographic material and are introduced therefrom into the developing medium during processing.

3. Method according to claim 2, wherein the developing agent (a) is present in the photographic material in an amount ranging from 0.1 to 5 g/m2.

4. Method according to claim 1, wherein said inorganic compound (b) is an alkaline metal hydrogen bisulphite or metabisulphite or a corresponding ammonium salt, the concentration of free sulphite ions being in the range of 15 to 80 grams per liter.

5. Method according to claim 2, wherein said anti-fogging agent (c) is present in the photographic material at a coverage up to 100 mg per m2.

6. Method according to claim 1, wherein the developer medium contains said anti-fogging agent (c) in a concentration up to 1000 mg per liter.

7. Method according to claim 1, wherein the anti-fogging agent is a 5- or 6-nitro-indazole.

8. Method according to claim 2, wherein said polymer containing a plurality of alkylene oxide units (d) is present in said photographic material in amount not surpassing 250 mg per m2.

9. Method according to claim 1, wherein said polymer containing a plurality of alkylene oxide units (d) is present in said developer medium in a concentration up to 2500 mg per liter.

10. Method according to claim 1, wherein the developer medium contains at least one organic watermiscible solvent for the developing agent (a).

11. Method according to claim 10, wherein said solvent is dimethylformamide, dimethylacetamide, n-methyl-2-pyrrolidinone and/or 3-methoxy-2-propanol.

12. Method according to claim 1, wherein the photographic material contains a silver bromide-iodide emulsion the silver halide of which contains no more than 10 mole % of iodide.

13. The method according to claim 1, wherein said developing agent (a) is present in said developing medium in a concentration in the range of 10 to 60 g/l.

* * * * *